United States Patent [19]

Murdock

[11] 4,390,165

[45] Jun. 28, 1983

[54] DECORATIVE GLASS PANEL RAILING ASSEMBLY

[75] Inventor: Robert H. Murdock, Kensington, Calif.

[73] Assignee: NEF Systems, Inc., Oakland, Calif.

[21] Appl. No.: 209,991

[22] Filed: Nov. 24, 1980

[51] Int. Cl.[3] ..... E04H 17/14; E04H 17/16

[52] U.S. Cl. ..... 256/24; 256/19; 256/59; 256/65

[58] Field of Search ..... 256/24, 25, 26, 22, 256/19, 59, 65, 73

[56] References Cited

U.S. PATENT DOCUMENTS

| | | | |
|---|---|---|---|
| 3,630,490 | 12/1971 | Horgan, Jr. | 256/24 |
| 3,770,245 | 11/1973 | Murdock | 256/24 |
| 3,879,017 | 4/1975 | Maxcy et al. | 256/65 |

FOREIGN PATENT DOCUMENTS

| | | | |
|---|---|---|---|
| 1807425 | 9/1970 | Fed. Rep. of Germany | 256/59 |
| 2114816 | 10/1971 | Fed. Rep. of Germany | 256/24 |
| 1538955 | 1/1979 | United Kingdom | 256/24 |

*Primary Examiner*—James Kee Chi

*Attorney, Agent, or Firm*—Harris Zimmerman; Howard Cohen

[57] ABSTRACT

A decorative glass panel railing assembly includes a plurality of spaced apart vertical line posts, each joined to an anchor plate which is secured to a floor or deck surface. Each line post includes a pair of channels formed therein on opposing sides thereof, each channel including a pair of opposed detent grooves extending longitudinally therein. A bottom glazing rail extends between each pair of line posts, with each end secured in a channel of the respective line posts. A glazing insert is disposed in each post channel atop the bottom glazing rail, and is secured therein by opposed detent flanges which engage the detent grooves of the channel and lock therein. The bottom glazing rail and the glazing inserts are each provided with a pile lined glazing channel therein to receive the edge of a glass panel. A glazing sub-rail extends between the upper ends of the line posts, with a top rail snappingly engaged atop the glazing sub-rail. The glazing sub-rail is secured to the line posts with screws received therein, the glazing sub-rail acting to compress longitudinally the glazing inserts and bottom rails to form a rigid structure. The glazing sub-rail also includes a pile lined glazing channel to receive the top edge of a glass panel. A pair of curb members extend longitudinally adjacent to either side of the bottom glazing rail, and are secured thereto flush to the floor surface.

19 Claims, 6 Drawing Figures

DECORATIVE GLASS PANEL RAILING ASSEMBLY

BACKGROUND OF THE INVENTION

There are known in the prior art various hand railing constructions which include the use of glass panels therein. Glass panel railings are often favored for use at the edge of floor surfaces, decks, stairs, or the like. In such situations, the glass panels provide maximum visibility and light transmission while at the same time providing maximum safety in preventing individuals or objects from falling from the surface on which the railing construction is installed.

In many of the prior art glass railing constructions, it is necessary to prepare extensively the surface on which the railing is to be installed. For example, many railing constructions employing glass panels require that special anchoring plates or lugs be installed in a concrete floor when the floor itself is being poured. In other systems, special holes must be formed in the floor surface so that the anchoring means may be secured therein.

Also, many of the prior art glass railing constructions employ fasteners to join the railing components together and to secure the glass panels to the assembly. These fasteners are exposed to the public, and are subject to tampering by vandals and thieves. Such tampering not only results in property loss, but also may adversely affect the structural integrity of the railing and pose a substantial yet unrecognized safety hazard. Furthermore, in railing constructions which support panes of tempered glass by means of bolts or screws extending therethrough, the glass panels must be sized and drilled prior to the tempering process. This results in a custom handling situation which is expensive and laborious.

SUMMARY OF THE PRESENT INVENTION

The present invention generally comprises a hand railing construction which includes glass panels supported thereby. A salient feature of the present invention is that all fasteners associated with the railing are completely covered by the component pieces of the railing, so that there is no opportunity for vandals or thieves to tamper with the installation. Furthermore, another salient feature of the invention is that each glass panel is supported on all edges by a cushioned slot in a rigid supporting member. The use of no exposed fasteners, plus the arrangement of the components of the railing, provides a railing construction which is aesthetically pleasing, structurally sound, and easily adapted to various site requirements.

The invention includes a plurality of upwardly extending line posts which are secured to a floor or deck surface in spaced apart fashion. Each line post is provided with a pair of longitudinal channels formed therein on opposing sides thereof. Each channel includes a pair of detent grooves formed in opposite sides of the channel and extending longitudinally therealong. The longitudinal channels of adjacent line posts open each toward the other.

Extending between the lower ends of adjacent line posts is a bottom glazing rail. The distal ends of the bottom glazing rail are received within the lower portions of the longitudinal channels of the adjacent line posts. The bottom glazing rail includes an upwardly opening glazing channel formed therein. The glazing channel is lined with mohair piling or the like to cushion and retain the lower edge portion of a glass panel.

Received in each line post channel atop the end of the bottom glazing rail is an upwardly extending glazing insert. Each glazing insert includes a lined glazing channel disposed in the same plane as the glazing channel of the bottom rail. Each glazing insert also includes outer flange portions which engage the detent grooves in the line post channels and are self retaining therein. The glazing insert extends from the bottom glazing rail upwardly in the channel of the line post to a point slightly higher than the upward extent of the line post.

Secured atop adjacent line posts is a glazing sub-rail which is secured to each line post by a plurality of screws extending through the sub-rail and secured in the top of the line post. The sub-rail includes a glazing channel aligned with the glazing channels of the post insert and the bottom rail, and is adapted to support the upper edge portion of a glass panel. The sub-rail also includes distal flange portions extending longitudinally therealong and adapted to resiliently and snappingly retain a top rail or hand rail directly superjacently thereto. The screws securing the sub-rail to the top of the line posts also cause the sub-rail to impinge upon the upper edges of the glazing inserts so that the line post assemblies are maintained rigid by virtue of the compressive forces acting thereon.

The invention also includes a pair of curb members extended between the lower ends of adjacent line posts and paired to impinge upon both sides of each bottom glazing rail. The curb members engage the lower edge portions of the bottom glazing rail, and are retained in place by this engagement. The curb members cover the anchor means which secure the bottom ends of the line posts to the floor surface, while the top rail covers the screw fasteners which secure the sub-rail to the tops of the line posts. As a result, there are no exposed fasteners in the completely assembled construction of the present invention. Furthermore, all edges of the glass panels disposed between adjacent line posts are fully supported and cushioned.

A BRIEF DESCRIPTION OF THE DRAWING

DESCRIPTION OF THE PREFERRED EMBODIMENT

Figure 1:
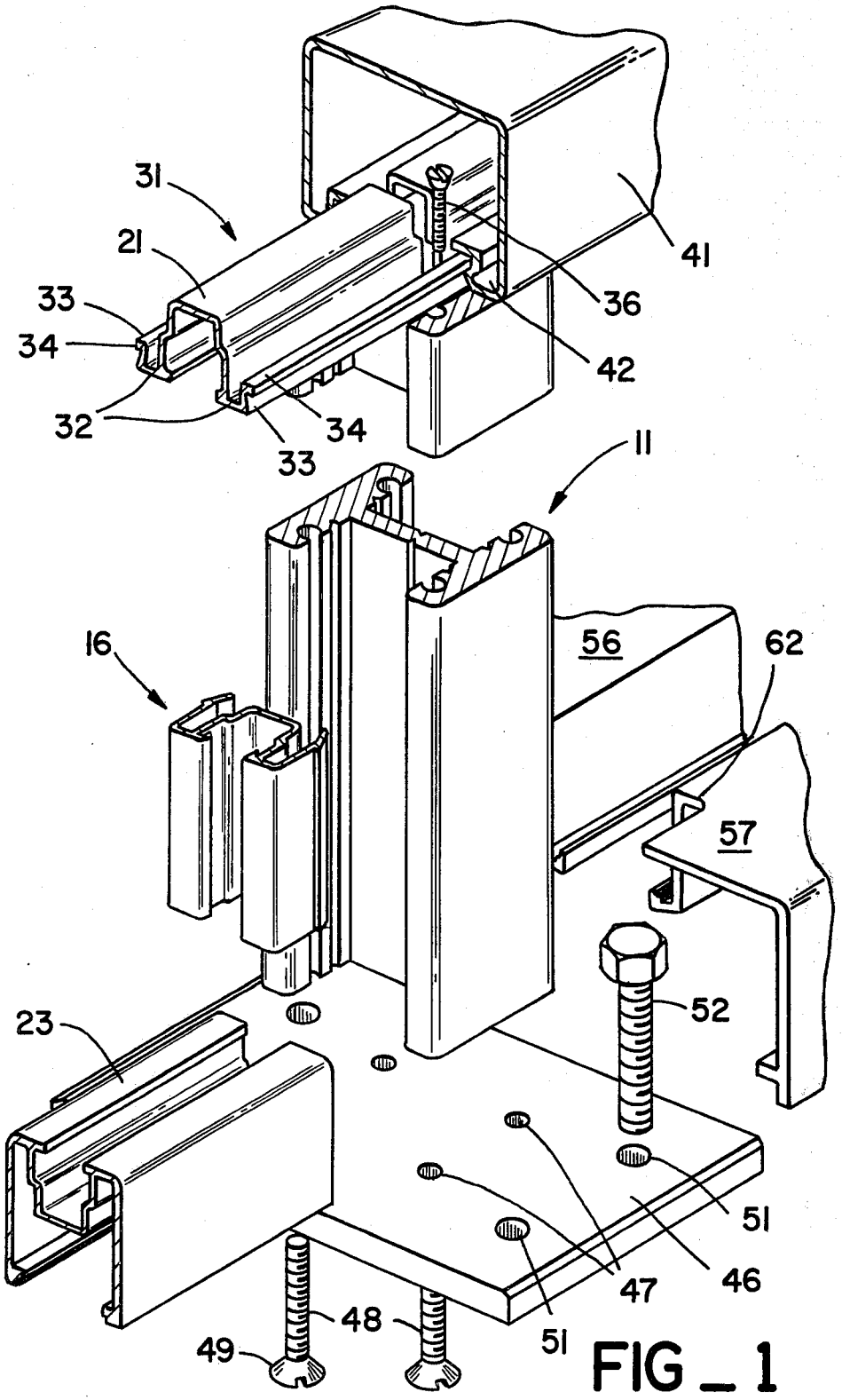
FIG. 1 is an exploded view of the glass panel railing construction of the present invention.
Figure 4:
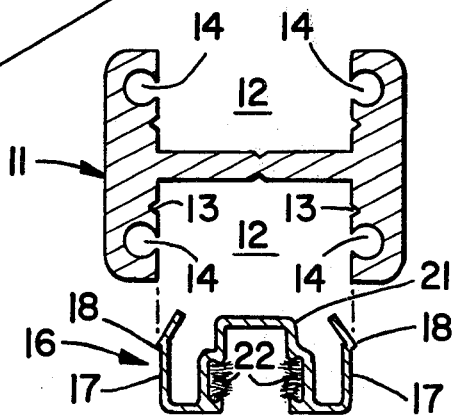
FIG. 4 is a horizontal cross-sectional view showing a line post and glazing insert of the present invention.

The present invention generally comprises a line rail construction which supports a plurality of glass panels extending between the floor or deck surface and a hand rail at the upper extent of the construction. With reference to FIGS. 1 and 4, the invention includes a plurality of line posts 11 disposed in spaced apart configuration and extending upwardly from a floor or deck surface. With reference to FIG. 4 in particular, each line post is provided with an H configuration which defines two channel openings 12 extending longitudinally on opposite sides of the post 11. Each channel 12 includes a pair of detent grooves 13 extending longitudinally on opposite sides of the channel. A pair of arcuate grooves 14 also extend longitudinally on opposite sides of each channel 12 adjacent to the grooves 13. This line post construction is disclosed in U.S. Pat. No. 4,047,703, issued Sept. 13, 1977, to Robert H. Murdock. This disclosure is incorporated herein by reference.

The invention also includes a plurality of glazing inserts 16, also shown in cross-section in FIG. 4. Each glazing insert 16 is a channel-like member having longitudinally extending outer legs 17 which are parallel, spaced apart, and adapted to impinge upon the opposed sides of the one of the channels 12 of the line post 11. The distal edges of the legs 17 taper inwardly. At the junction of the tapered portions and the legs 17 there is formed a detent flange 18 which extends outwardly slightly from the plane of the legs 17. The detent flanges 18 are formed and disposed to engage in snapping fashion the detent grooves 13 in the channel 12, so that the glazing insert 16 is self-retaining in the channel 12. The tapered portion of the legs 17 permit the glazing insert to be inserted into the channel, as shown in FIG. 4, unil the flanges 18 engage the grooves 13. This engagement prevents removal of the insert 16, although the insert is translatable along the longitudinal extent of the channel 12.

Figure 6:
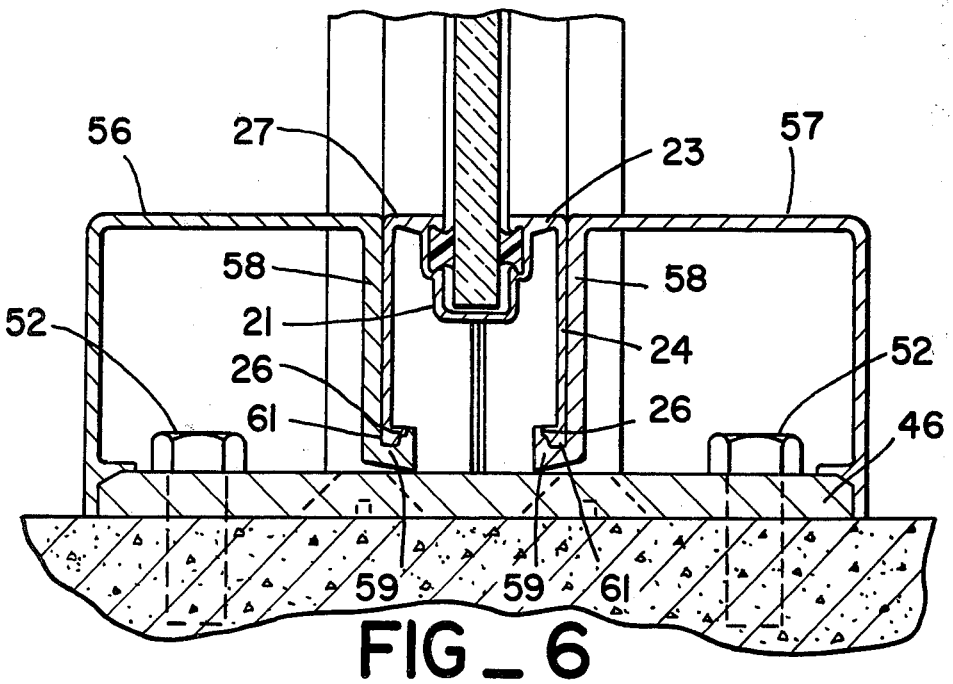
FIG. 6 is a cross-sectional elevation taken along line 6—6 of FIG. 5.

The legs 17 extend from the opposed edges of a glazing channel 21. The glazing channel 21 also extends longitudinally and opens outwardly in the same direction as the channel 12 in which the glazing insert 16 is received. The width of the glazing channel 21 is slightly greater than the thickness of the panel of glass to be supported by the railing construction. Each glazing channel 21 includes a pair of longitudinally extending recesses 22 which are disposed on opposite sides of the channel 21 directly adjacent to the opening thereof. The recesses 22 are provided with a pile lining or the equivalent to provide a soft, resilient surface to impinge upon the edge portion of the glass panel.

the invention also includes a plurality of bottom glazing rails 23 which extend between the lower ends of adjacent line posts 11. As shown in FIGS. 1 and 6, the bottom glazing rail 23 includes a pair of opposed vertical sides 24, with a flange 26 extending inwardly from the lower edge of each side 24. The top surface 27 of the bottom glazing rail is generally orthogonal to the sides 24. A glazing channel 21 extends the length of the bottom glazing rail, and is secured to and opens to the upper surface 27 thereof. The glazing channel 21 of the bottom rail 23 is very similar to the glazing channel of the post insert 16, as shown in FIG. 4, and described in the preceding. The sides 24 of the bottom rail 23 are spaced so that the distal ends of the bottom rail 23 may be received within the channels 12 of adjacent line posts 11 with minimal clearance.

Figure 2:
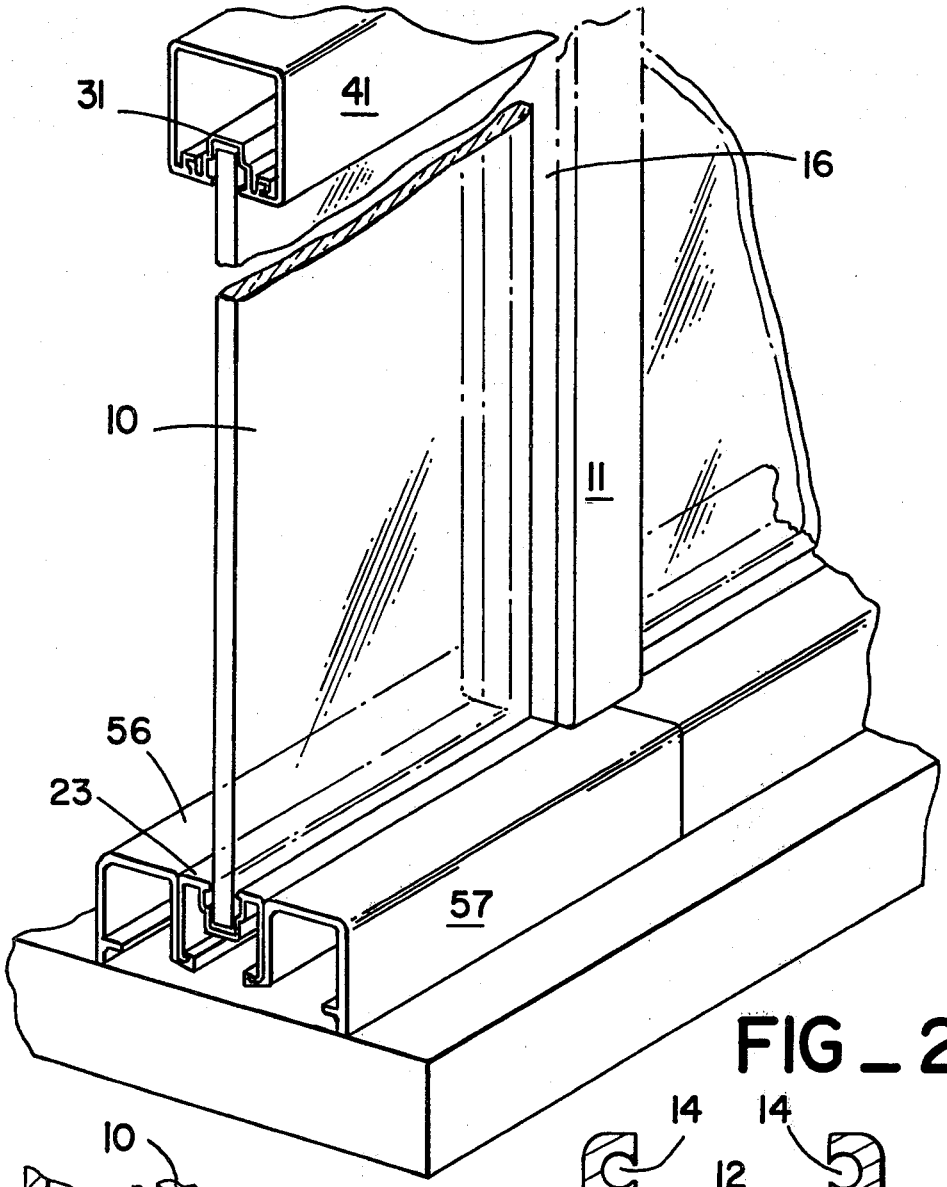
FIG. 2 is a perspective view of the glass panel railing construction of the present invention.

The railing construction of the present invention also includes a glazing sub-rail 31 which is secured to and extends between the upper surfaces of adjacent line posts 11. As shown in FIGS. 1 and 2, the glazing sub-rail 31 includes a glazing channel portion 21 extending the length thereof. This glazing channel 21 is substantially identical to the glazing channels of the insert 16 and the bottom glazing rail 23. Extending outwardly from the opposed edges of the channel 21 are narrow web portions 32. A pair of flanges 33 extend upwardly from the distal edges of the web portions 32. A lip 34 is formed at the upper edge of each flange 33. The lips 34 extend laterally outwardly from the flanges 33 for reasons which will be explained in the following.

The web portions 32 of the sub-rail 31 are disposed to impinge directly atop the openings of the longitudinally extending grooves 14 of the posts 11. Holes are formed in the web portions 32, and are disposed in registration with the end openings of the grooves 14. A pair of self-tapping screws 36 extend through the holes in the web portions 32 and are secured in the grooves 14 of the posts 11.

A top rail 41 is secured superjacently with respect to the glazing sub-rail 31. The top rail 41 comprises a generally rectangular channel member having a downwardly opening cavity extending longitudinally therein. The opposed lower edges of the sides of the top rail 41 are provided with inwardly extending flanges 42 extending longitudinally therealong. The inner edges of the flanges 42 are bevelled downwardly and outwardly, with the distance between the bevelled inner edges being substantially equal to the distance between the outer surfaces of the lips 34. It may be appreciated that the top rail 41 is placed directly above the glazing sub-rail 21 and aligned therewith, the bevelled inner edges of the flanges resting on the lips 34 of the sub-rail 21. The top rail 41 is then urged downwardly, the bevelled edges of the flanges 42 acting to expand laterally the opposed sides of the top rail 41. The bevelled edges of the flanges 42 are thus caused to snap into engagement with the lower surfaces of the lips 34 and the outer surfaces of the flanges 33. This snapping engagement firmly retains the top rail 41 to the sub-rail 31. At the same time, the top rail 41 completely covers the screws 36 which join the entire assembly together. As a result, there are no exposed fasteners, and there is no way that a vandal or thief could gain access to the screws 36 to disassemble the railing construction.

The railing construction of the present invention also includes a plurality of anchor plates 46, each anchor plate being secured to the lower end of a line post 11 and also to the floor or deck surface on which the railing assembly is installed. The anchor plate 46 includes a quartet of screw holes 47 extending through the medial portion thereof and aligned with the end openings of the longitudinal slots 14 of the line post 11. A quartet of self-tapping screws or bolts 48 extends from the bottom of the anchor plate through the holes 47 and are secured in the grooves 14 of the line post. The heads 49 of the screws 48 are countersunk in the plate 46 to be flush with the bottom surface thereof.

Figure 3:
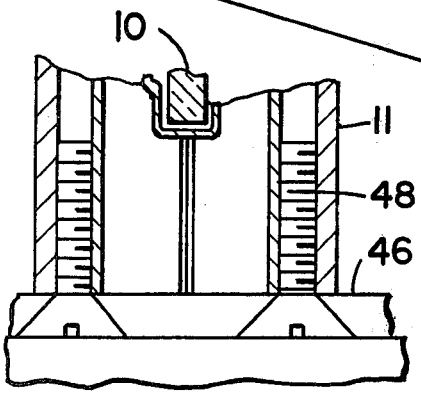
FIG. 3 is an enlarged, vertical cross-section of each line post-anchor plate assembly of the present invention.

The anchor plate 46 also includes another quartet of holes 51 disposed peripherally of the holes 47. The holes 51 are provided to receive a quartet of lag bolts 52 or the like extending therethrough from the upper end and secured in the floor or deck surface. It may be appreciated that the screws 48 join the line post 11 to the plate 46, while the lag bolts 52 or equivalent join the plate 46 to the floor or deck surface, as shown in FIGS. 3 and 6.

Another feature of the railing construction of the present invention is the provision of a plurality of curb members 56 and 57. The curb members extend between the lower ends of adjacent line posts 11, each impinging directly upon one of the laterally extending sides of the bottom glazing railing 23. Each curb member generally comprises a rectangular channel member having a downwardly opening cavity therein. The side portion 58 of each curb member 56 and 57 which impinges on the bottom glazing rail 23 is generally parallel to and flush with the sides of the bottom glazing rail. Furthermore, the side portions 58 include a flange 59 extending inwardly from the lower edge thereof, as shown in FIGS. 1 and 6. The flanges 59 define an upwardly opening groove 61 extending the length of the curb member and adapted to receive the flange 26 formed at the lower edges of the sides of the bottom glazing rail 23.

Figure 5:
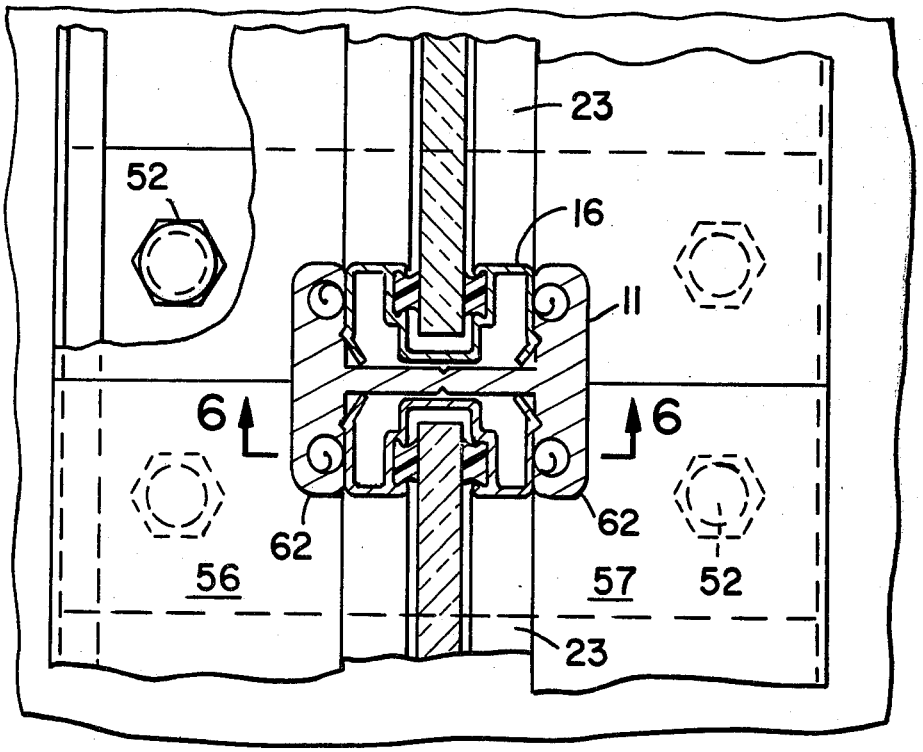
FIG. 5 is a horizontal cross-sectional view taken through a line post assembly of the present invention.

As shown in FIG. 1, the curb members 56 and 57 are provided with rectangular cut-outs 62 at both ends thereof. The cut-outs 62 remove the inside corner portions of the curved members to accommodate the corner portions of the line posts 11, as shown, for example, in FIGS. 2 and 5. The curb members thus completely surround and enclose the anchor plate 46, so that the lag bolts 52 are completely hidden from view or access.

With reference to FIG. 6, it may be appreciated that the engagement of the flanges 26 of the bottom glazing rails 23 in the grooves 61 of the curb members 56 and 57 effectively immobilizes the curb members with respect to the bottom glazing rail. This engagement prevents upward movement of the curb members with respect to the bottom glazing rail, as well as any rotational movement with respect thereto. The curb members prevent damage to the bottom glazing rail, and absorb any impact shock from foot traffic or the like which might otherwise be transmitted to the glass panels of the railing assembly.

To install the railing construction of the present invention, it is first necessary to mark the locations of the line posts 11 on the floor or deck surface to which the railing is to be secured. The anchor plates 46 are then joined to the lower ends of the posts 11 by means of the screws 48, and the anchor plates 46 are then secured to the floor or deck surface by means of the lag screws 52. Next, the curb members 56 and 57 are laid out between the posts 11, and the bottom glazing rails 23 are also laid out between adjacent curb members 56 and 57 with the ends of the bottom glazing rails disposed within the longitudinal cavities 12 of the posts 11.

The next step in the installation process is the assembly of the glazing inserts 16 into the longitudinal cavities 12 of the posts 11. The inserts 16 may be snapped into the channel portions 12 so that the flanges 18 of the inserts engage the detent grooves 13 of the channels 12. The vertical length of the inserts 16 is carefully controlled so that the bottom edge of each insert 16 impinges upon its respective bottom glazing railing 23, while the upper edge of the glazing insert 16 is disposed slightly above the upper surface of the post 11.

It may be appreciated that the glazing channels 21 of the inserts 16 and the bottom glazing rails 23 are aligned in the same plane. The next step in the installation procedure is the introduction of a glazing panel 10 into the glazing channels of each bottom glazing rail 23 and the two associated post inserts 16 at either end thereof. This is accomplished by sliding the glazing panel 10 into the upper openings of the glazing channels of the post inserts 16, and sliding the panel downwardly until the lower edge portion thereof is seated in the glazing channel of the bottom glazing rail.

The glazing sub-rail 31 is then secured atop adjacent posts 11 by means of the self-tapping screws 36, as explained in the foregoing. As the screws 36 are tightened down to join the sub-rail 31 firmly to the tops of the posts 11, the sub-rail 31 exerts an increasing compressive force upon the upper edge of the post inserts 16. This compressive force, which is typically on the order of 2000 pounds, immobilizes the assembled parts and provides a rattle-free construction. After the sub-rail 31 is joined to the posts 11, all four edges of each glazing panel 10 are seated in glazing channels 21 of the railing. Thus the entire periphery of each panel 10 is fully cushioned and supported to take advantage of the maximum strength of the glass panel.

The last step in assembling the railing construction is to secure the top rail 41 to the sub-rail 31. This is accomplished by laying the top rail 41 on the sub-rail 31 as shown in FIGS. 1 and 2, and urging the top rail 41 downwardly with sufficient force or impact to cause the flanges 42 to engage the lips 34 of the sub-rail 31.

The completed construction completely hides the fasteners which join the assembly together, so that there is no opportunity for tampering or vandalism. Furthermore, the high compressive force which joins the assembled parts provides the railing construction with a very firm feel, greatly enhancing the security afforded by the railing construction. Also, the glass panels mounted in the railing construction are fully supported at their edges, yet are free from torsional forces and thermal expansion problems known in the prior art.

I claim:

1. A decorative glass panel railing assembly, comprising; a plurality of upwardly extending line posts disposed in generally parallel, spaced apart configuration, each of said posts including a pair of post channels extending longitudinally and disposed on opposed sides of said post; anchor means for securing said posts to the floor; a plurality of glazing inserts, each adapted to be received in one of said post channels, each glazing insert including a channel-like cavity therein and cushioning means disposed in said channel-like cavity to engage a vertical edge portion of a glass panel; detent means for retaining said glazing inserts in said post channels; first means for supporting a lower horizontal edge portion of a glass panel; second means for supporting an upper horizontal edge portion of a glass panel; and top rail means secured to said second means.

2. The railing assembly of claim 1, wherein said second means impinges compressively on the upper ends of said glazing inserts to maintain said assembly rigid and rattle-free.

3. The railing assembly of claim 1, wherein said second means includes a plurality of sub-rails extending between the upper ends of said line posts and secured thereto.

4. The railing assembly of claim 3, wherein said sub-rails each include a glazing channel extending therealong and opening downwardly to receive an upper edge portion of a glass panel.

5. The railing assembly of claim 3, wherein said second means includes screw means extending through said sub-rails and secured in the upper end of said line posts.

6. The railing assembly of claim 5, wherein said line posts include arcuate grooves extending longitudinally therein, said screw means being secured in the end openings of said arcuate grooves.

7. The railing assembly of claim 3, wherein each of said sub-rails includes a pair of opposed flanges extending therealong and projecting laterally outwardly therefrom.

8. The railing assembly of claim 7, wherein said top rail comprises a rectangular, channel-like member having spaced apart sides, and means at the lower edges of said sides for engaging said opposed flanges of said sub-rail in snapping, retaining fashion.

9. A decorative glass panel railing assembly, comprising; a plurality of upwardly extending line posts disposed in generally parallel, spaced apart configuration, each of said posts including a pair of post channels extending longitudinally and disposed on opposed sides of said post; anchor means for securing said posts to the floor; a plurality of glazing inserts, each adapted to be received in one of said post channels and adapted to engage a vertical edge portion of a glass panel; detent means for retaining said glazing inserts in said post channels, including grooves extending longitudinally in said post channels, and flanges extending from said glazing inserts for snapppingly engaging said grooves; first means for supporting a lower horizontal edge portion of a glass panel; second means for supporting an upper horizontal edge portion of a glass panel; and top rail means secured to said second means.

10. A decorative glass panel railing assembly, comprising; a plurality of upwardly extending line posts disposed in generally parallel, spaced apart configuration, each of said posts including a pair of post channels extending longitudinally and disposed on opposed sides of said post; anchor means for securing said posts to the floor; a plurality of glazing inserts, each adapted to be received in one of said post channels and adapted to engage a vertical edge portion of a glass panel; detent means for retaining said post inserts in said post channels; a plurality of bottom glazing rails, each extending between a pair of adjacent line posts and adapted to support the lower edge of a glass panel, a plurality of curb members, each extending between adjacent line posts and impinging upon the sidewall of the bottom glazing rail extending therebetween to protect said bottom glazing rail and said lower edge of said panel, means for supporting an upper horizontal edge portion of the glass panel; and top rail means secured to said means.

11. The railing assembly of claim 10, wherein the distal end portions of said bottom glazing rails are received in the post channels of their respective line posts.

12. The railing assembly of claim 10, wherein each of said bottom glazing rails includes a glazing channel extending the length thereof and adapted to receive the lower horizontal edge portion of a glass panel.

13. The railing assembly of claim 11, wherein the lower end of each glazing insert impinges upon the distal end portion of a bottom glazing rail received in their common post channel.

14. The railing assembly of claim 10, wherein each of said bottom glazing rails comprises a rectangular, channel-like member having a glazing channel extending therealong and opening upwardly to receive a lower horizontal edge portion of a glass panel.

15. The railing assembly of claim 10, wherein said bottom glazing rails each include a pair of spaced apart side panels extending therealong with lower edge portions depending therefrom.

16. The railing assembly of claim 15, wherein said curb members include means for engaging said lower edge portions of said bottom glazing rail to secure said curb members to said bottom glazing rail.

17. The railing assembly of claim 16, wherein said curb members include cutout portions at opposed ends thereof to receive portions of said line posts therein.

18. The railing assembly of claim 16, wherein said curb members comprise generally rectangular, channel-like members.

19. A decorative glass panel railing assembly, comprising; a plurality of upwardly extending line posts disposed in generally parallel, spaced apart configuration, each of said posts including a pair of post channels extending longitudinally and disposed on opposed sides of said post; anchor means for securing said posts to the floor, said anchor means including a plurality of anchor plates, each secured to one of said line posts and to said floor; curb means extending between said line posts and disposed to cover completely said anchor plates and prevent access thereto; glazing means disposed in said post channels and adapted to engage vertical edge portions of a glass panel; and railing means extending between said line posts.

* * * * *